US009828813B2

(12) United States Patent
Zhang et al.

(10) Patent No.: US 9,828,813 B2
(45) Date of Patent: Nov. 28, 2017

(54) FIBRE COMPOSITE ROD PETROLEUM WELL INTERVENTION CABLE

(71) Applicant: C6 TECHNOLOGIES AS, Stavanger (NO)

(72) Inventors: Wenting Zhang, Sola (NO); Tore Aarsland, Nærbø (NO)

(73) Assignee: C6 TECHNOLOGIES AS, Stavanger (NO)

( * ) Notice: Subject to any disclaimer, the term of this patent is extended or adjusted under 35 U.S.C. 154(b) by 346 days.

(21) Appl. No.: 14/430,071

(22) PCT Filed: Oct. 18, 2012

(86) PCT No.: PCT/NO2012/000059
§ 371 (c)(1),
(2) Date: Mar. 20, 2015

(87) PCT Pub. No.: WO2014/062061
PCT Pub. Date: Apr. 24, 2014

(65) Prior Publication Data

US 2015/0226021 A1 Aug. 13, 2015

(51) Int. Cl.
*E21B 17/00* (2006.01)
*E21B 17/20* (2006.01)
(Continued)

(52) U.S. Cl.
CPC ..... *E21B 17/206* (2013.01); *E21B 17/003* (2013.01); *H01B 7/046* (2013.01); *H01B 7/183* (2013.01); *H01B 9/04* (2013.01)

(58) Field of Classification Search
CPC ..... E21B 17/206; E21B 17/003; H01B 7/046; H01B 7/183; H01B 9/04
See application file for complete search history.

(56) References Cited

U.S. PATENT DOCUMENTS 4,960,965 A * 10/1990 Redmon ..... H01B 11/1808 174/102 R
5,285,008 A * 2/1994 Sas-Jaworsky ..... E21B 17/203 138/115

(Continued)

FOREIGN PATENT DOCUMENTS

CN 101448890 A 6/2009
EP 1 760 252 A1 3/2007

(Continued)

*Primary Examiner* — Daniel P Stephenson
(74) *Attorney, Agent, or Firm* — Birch, Stewart, Kolasch & Birch, LLP

(57) ABSTRACT

A fiber composite rod intervention cable includes a central electrical cable portion; a bonding layer; a generally unidirectional carbon fiber composite mantle layer; a protective, balanced braided fiber composite layer. The central electrical cable portion includes a generally central electrical conductor with a first cross-section conductive area; an inner insulation layer on the central electrical conductor; and a coaxial electrical conductor layer having a second cross section conductive area equal to the first cross-section conductive area. The fiber composite rod intervention cable is arranged for being injected into a well from a drum unit via an injection unit at the wellhead and may carry an intervention tool, a logging tool, a well tractor with or without an energy source.

24 Claims, 4 Drawing Sheets

(51) Int. Cl.

| | |
|---|---|
| ***H01B 7/04*** | (2006.01) |
| *H01B 7/18* | (2006.01) |
| *H01B 9/04* | (2006.01) |

(56) References Cited

U.S. PATENT DOCUMENTS

| | | | | |
|---|---|---|---|---|
| 5,304,739 | A * | 4/1994 | Klug | H01B 3/443 174/102 R |
| 8,413,723 | B2 * | 4/2013 | Varkey | E21B 17/206 166/339 |
| 2003/0155127 | A1 * | 8/2003 | Carlsen | E21B 19/002 166/368 |
| 2007/0128435 | A1 * | 6/2007 | Hiel | B29C 70/52 428/375 |
| 2009/0250241 | A1 | 10/2009 | Galletti et al. | |
| 2009/0260834 | A1 * | 10/2009 | Henson | E21B 17/206 166/385 |
| 2010/0243316 | A1 * | 9/2010 | Inderberg | B29C 70/20 174/70 R |
| 2011/0253415 | A1 * | 10/2011 | Muschiatti | H01B 11/1821 174/107 |
| 2012/0073856 | A1 * | 3/2012 | Montena | H01B 11/1813 174/105 R |
| 2013/0273290 | A1 * | 10/2013 | Luo | F16L 9/147 428/36.92 |
| 2014/0174813 | A1 * | 6/2014 | Doneker | H05K 9/0088 174/358 |
| 2015/0184469 | A1 * | 7/2015 | Sherman | E21B 17/206 385/101 |
| 2015/0187465 | A1 * | 7/2015 | McErlean | H01R 13/005 174/28 |
| 2015/0210846 | A1 * | 7/2015 | Qi | C08G 59/26 174/126.1 |
| 2015/0226021 | A1 * | 8/2015 | Zhang | H01B 7/046 166/65.1 |
| 2016/0099090 | A1 * | 4/2016 | Huang | H01B 1/023 174/102 A |
| 2017/0133124 | A1 * | 5/2017 | Thomas | H01B 7/046 |

FOREIGN PATENT DOCUMENTS

| | | | | |
|---|---|---|---|---|
| EP | 2 312 360 | A1 | 4/2011 | |
| FR | GB 2533574 | A * | 6/2016 | F16L 11/088 |
| WO | WO 0201580 | A1 * | 1/2002 | H01B 7/0009 |
| WO | WO 2006/003477 | A2 | 1/2006 | |
| WO | WO 2006/054092 | A1 | 5/2006 | |

* cited by examiner

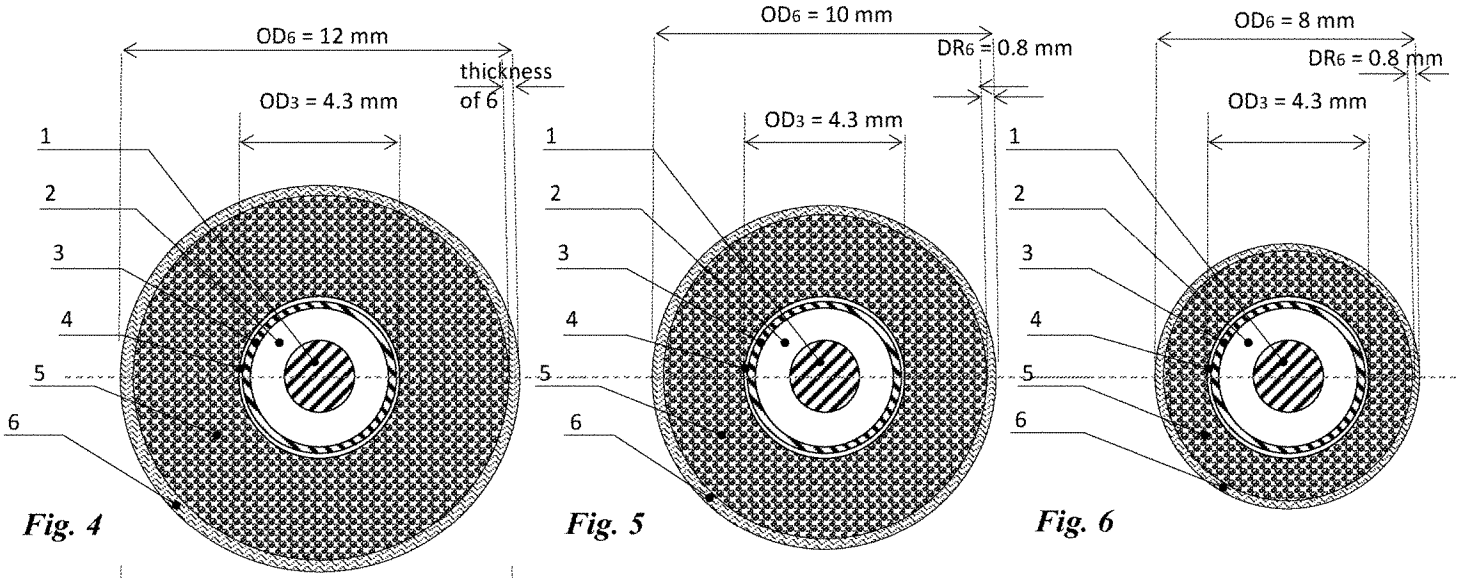
Fig. 4
Fig. 5
Fig. 6
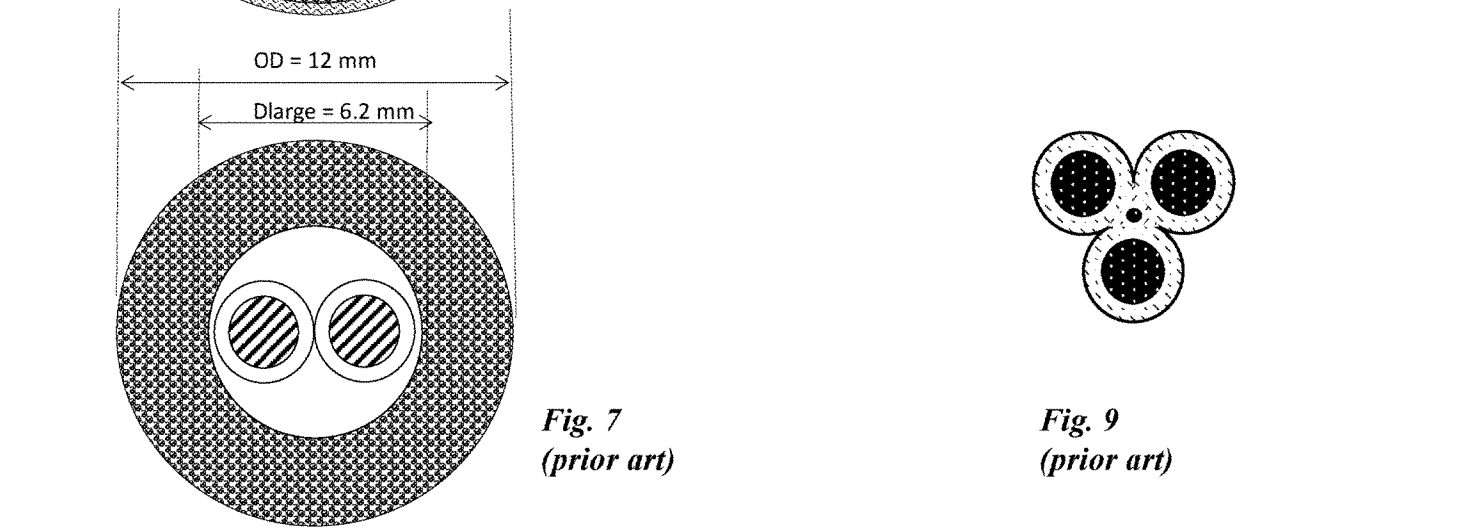
Fig. 7
(prior art)
Fig. 9
(prior art)

FIBRE COMPOSITE ROD PETROLEUM WELL INTERVENTION CABLE

INTRODUCTION

The invention is a fibre composite rod petroleum well intervention power cable (0) of which a cross-section is shown in FIG. 1. The fibre composite rod petroleum well intervention cable is injected into the well from a drum unit via an injection unit at the wellhead and may carry an intervention tool, a logging tool, a well tractor with or without an energy source. The rod is resiliently flexible and self-straightening when bent with a radius larger than a given minimum radius, so as for being spoolable on a drum of about 4 meters diameter or less. The diameter of the rod of the invention is between 8 and 12 mm and the length is up to 10 000 m or more.

BACKGROUND ART

EP patent number EP2312360 describes a carbon fibre intervention cable rod with three parallel and mutually insulated electrical conductors wherein the bundle of said three insulated electrical conductors are pultruded in a process adding a structural carbon fibre layer to make a rod which may be injected into a production well. The carbon fibres are parallel in order to maximize tensile strength of the rod. A disadvantage with such a structural carbon fibre layer is that it may disrupt radially and break partially or snap off entirely, such as when pushed with a force of about 5000 N or when subject to a sudden pressure drop.

Pultruded composite rods with a mantle of unidirectional carbon fibre around a core constituted by two parallel electrical conductors, as illustrated in FIGS. 3 and 7 or three electrical conductors are known in the field of petroleum intervention such as in the above EP2312360. When used in a petroleum well, high-pressure intrusion of fluids may incur disintegration of the unidirectional carbon fibres when the pressure is abruptly relieved, particularly when being hauled out when the rod cable leaves the grease stuffing box at the top of the wellhead where the pressure gradient is at its highest. The rod's unidirectional fibres may disrupt laterally and easily disintegrates further, and becomes longitudinally soft and completely useless for injection, when pushing the rod into the well, so-called "rodding", at the very same instant, even for minor outbreaks. In case of such a disruption, the entire rod on the reel has to be replaced. If the rod breaks in the well the portion remaining inside the well must be fished. Fishing a highly split broken end of a carbon fibre rod is a difficult task because it splits into an irregular bundle of separate strands of different thicknesses.

An electrical cable core of a carbon fibre intervention rod with twisted insulated electrical conductors of the background art is illustrated in FIG. 3. The carbon fibre mantle portion with unidirectional carbon fibres is omitted, but the entire cross-section of such a rod with the unidirectional fibre mantle is shown in FIG. 7. The cable core of the background art composite rod is provided with two closely arranged insulated conductors, said two conductors having a minimum thickness of insulation so as for avoiding local electrical short-circuit between the two conductors. The cross-section areas of each of the two conductors are equal.

Coaxial signal cables are often provided with a thin insulated centric signal wire and a rather rugged coaxial screen of far higher cross-section area, of which the role of the coaxial screen is purely for the role of screening the centric signal wire from external electromagnetic signals, and of which the centric signal wire shall have optimal signal transmission properties.

BRIEF SUMMARY OF THE INVENTION

The invention is a fibre composite rod intervention power cable (0) of which a cross-section is shown in FIG. 1. The fibre composite rod petroleum well intervention power cable (0) of the invention is for use in a petroleum well, and has a length of at least 2 to 10 km or more. The invention is a fibre composite rod petroleum well intervention power cable (0) comprising, in the following sequence:

- a central electrical cable portion (1, 2, 3),
- a bonding layer (4),
- a generally unidirectional carbon fibre composite mantle layer (5),
- a braided fibre composite layer (6),
- wherein said central electrical cable portion (1, 2, 3) comprises
- a generally central electrical conductor (1) with a first cross-section conductive area (A1),
- an inner insulation layer (2) on said central electrical conductor (1), and
- a coaxial electrical conductor layer (3) having a second cross section conductive area (A2) equal to said first cross-section conductive area (A1).

Stated otherwise, the invention is a fibre composite rod petroleum well intervention power cable (0) comprising, in the following sequence:

- a central electrical cable portion (1, 2, 3),
- a bonding layer (4),
- a generally unidirectional carbon fibre composite mantle layer (5), characterized by
- a braided fibre composite layer (6),
- wherein said central electrical cable portion (1, 2, 3) comprises
- a generally central electrical conductor (1) with a first conductivity (S1)
- an inner insulation layer (2) on said central electrical conductor (1), and
- a coaxial electrical conductor layer (3) having a second conductivity (S2) equal to said first conductivity (S1).

The term conductivity used above relates to the total conductivity of the given cross-section area (A1) or (A2), respectively.

The invention may also be expressed as a fibre composite rod petroleum well intervention power cable (0) comprising, in the following sequence:

- a central electrical cable portion (1, 2, 3), comprising a generally central electrical conductor (1) with a first conductive cross-section area (A1), with an inner insulation layer (2) on said central electrical conductor (1), and a coaxial electrical conductor layer (3) having a second cross section conductive area (A2) equal to said first cross-section conductive area (A1),
- a bonding layer (4),
- a generally unidirectional carbon fibre composite mantle layer (5),
- a braided fibre composite layer (6).

The invention may also be expressed as a fibre composite rod petroleum well intervention power cable (0) comprising, in the following sequence:

- a central electrical cable portion (1, 2, 3), comprising a generally central electrical conductor (1) with a first conductivity (S1), with an inner insulation layer (2) on said central electrical conductor (1), and a coaxial electrical conductor layer (3) having a conductivity (S2) equal to said first conductivity (S1), a bonding layer (4), a generally unidirectional carbon fibre composite mantle layer (5), a braided fibre composite layer (6).

Advantages of the invention are mentioned under the paragraph describing embodiments of the invention.

FIGURE CAPTIONS

The invention and an example of background art is illustrated in the attached drawing figures wherein FIG. 1 is a cross-section of the fibre composite rod petroleum well intervention power cable of the invention comprising a general coaxial conductor electrical power cable portion (1,2,3) at the centre and a cylindrical structural carbon fibre composite mantle portions (5,6) out to the full diameter.

FIGS. 4, 5, and 6 are Illustrations of embodiments of the invention wherein a braided fibre composite layer (6), with a thickness of between 0.4 and 1.0 mm, here of 0.8 mm, forms an outer layer of a 12 mm Ø cable, a 10 mm Ø cable, and an 8 mm Ø cable, respectively. All illustrations show a centre conductor having a cross-section area $A_1$ of 2.63 $mm^2$. The coaxially arranged conductor (3) has the same conductive area $A_3$ throughout.

Figure 3:
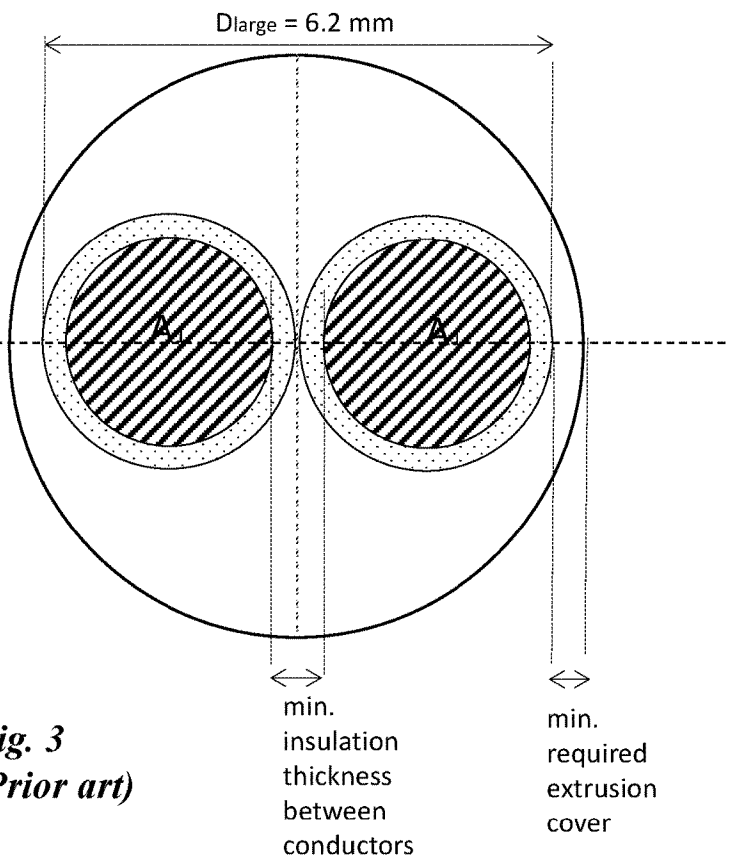
Fig. 3 (Prior art)
FIG. 3 is an illustration of a background art parallel or twisted parallel conductor cable which is filled in and covered by a covered by a high-temperature resistant polymer which may form the core of an intervention fibre composite cable shown in FIG. 7.

FIG. 7 illustrates a background art fibre composite rod power cable with an electrical cable core as shown in FIG. 3 with two parallel conductors each having a cross-section area $A_1$ of 2.63 $mm^2$. The two parallel conductors of the background art cable are twisted about 14 to 20 times per meter of running length and provided with a high-temperature resistant fill-in polymer to form an electrical insulated core cable of circular cross-section. The central parallel twisted cable with polymer fill-in is provided with an extruded layer of unidirectional carbon fibre composite up to a diameter of 12 mm.

Figure 8:
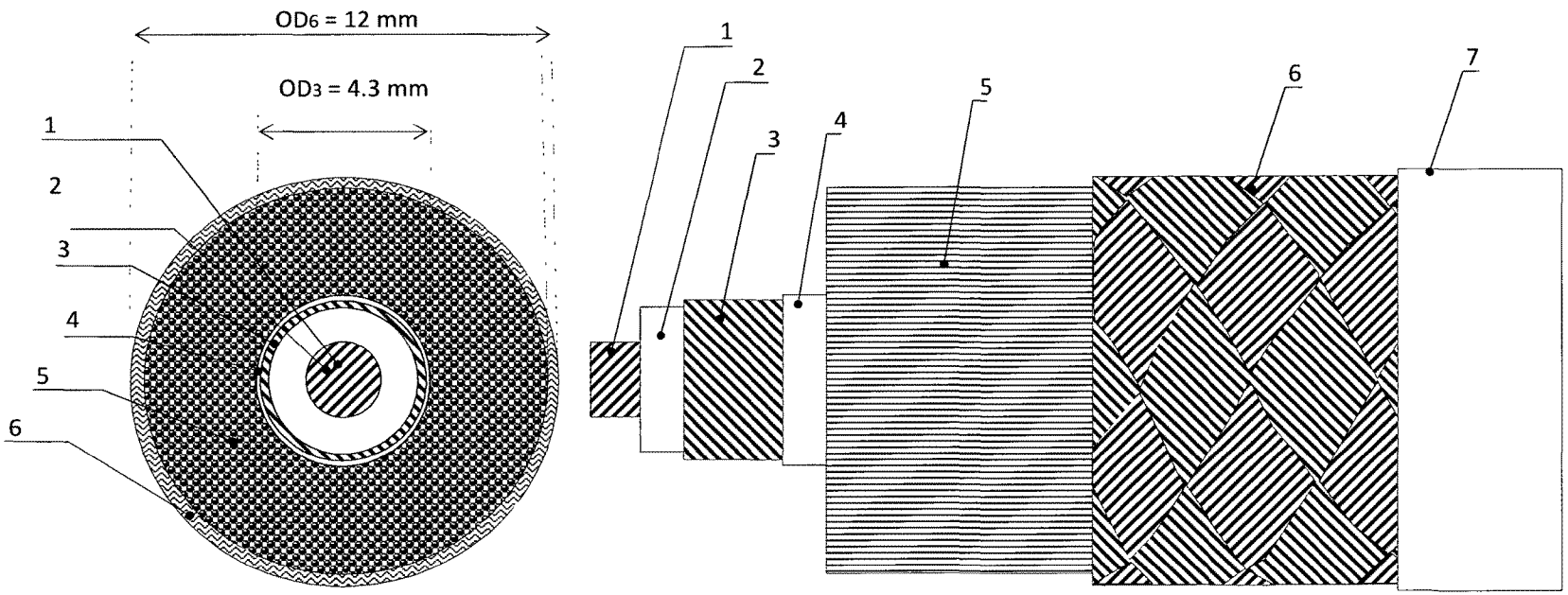

FIG. 8 is, in the right portion, a lateral view on the rod of the invention. It is a partially stripped end of the rod showing the thin braided fibre composite layer (6) on the unidirectional fibre composite mantle layer (5), with the central electrical cable portion (1, 2, 3) in centre, surrounded by bonding layer (4). In the left portion of the drawing a copy the section shown in FIG. 4 is shown. A possible additional outer protective and proofing surface coating layer (7) is indicated to the right.

FIG. 9 is a cross-section of a bundle of three separate insulated conductors in the core of the above-mentioned EP-patent EP2312360

EMBODIMENTS OF THE INVENTION

The Petroleum Well Intervention Rod in General

Figure 1:
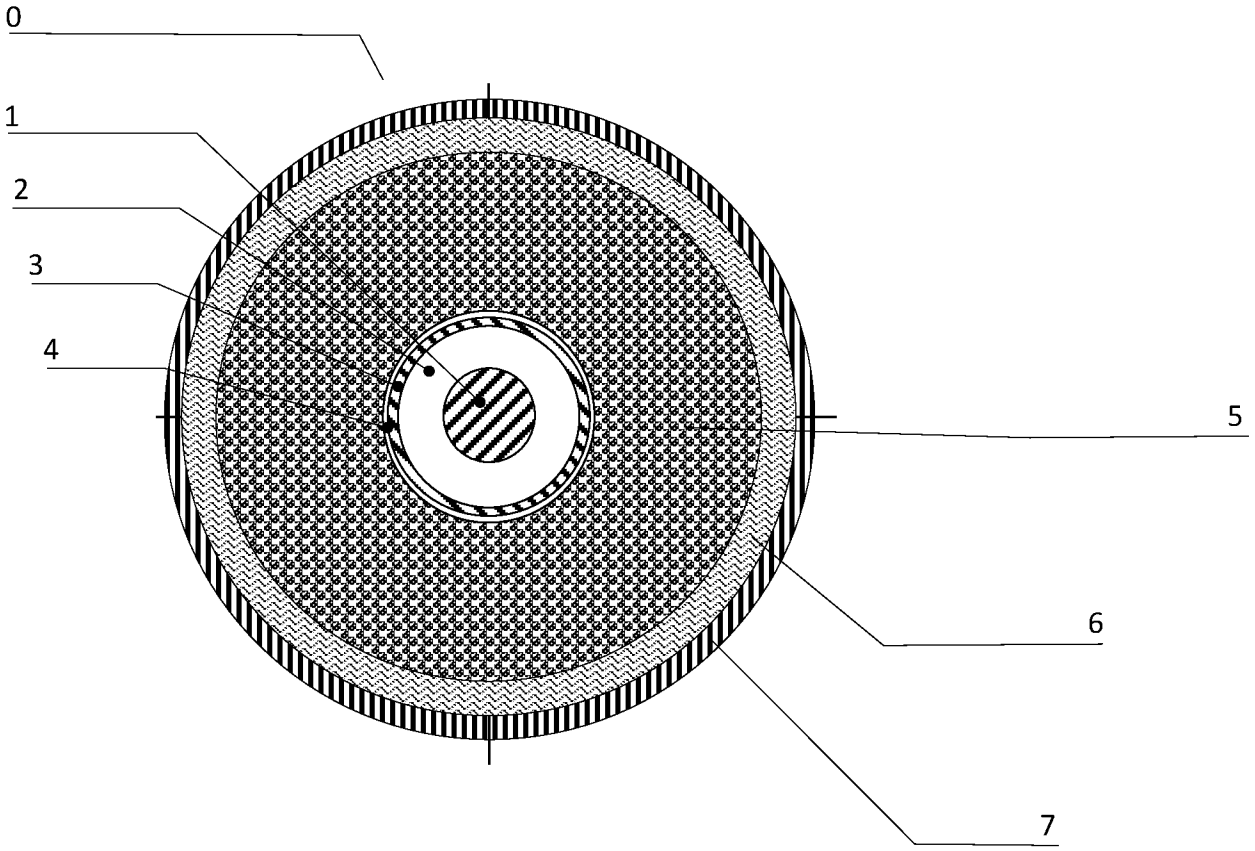
Figure 2:
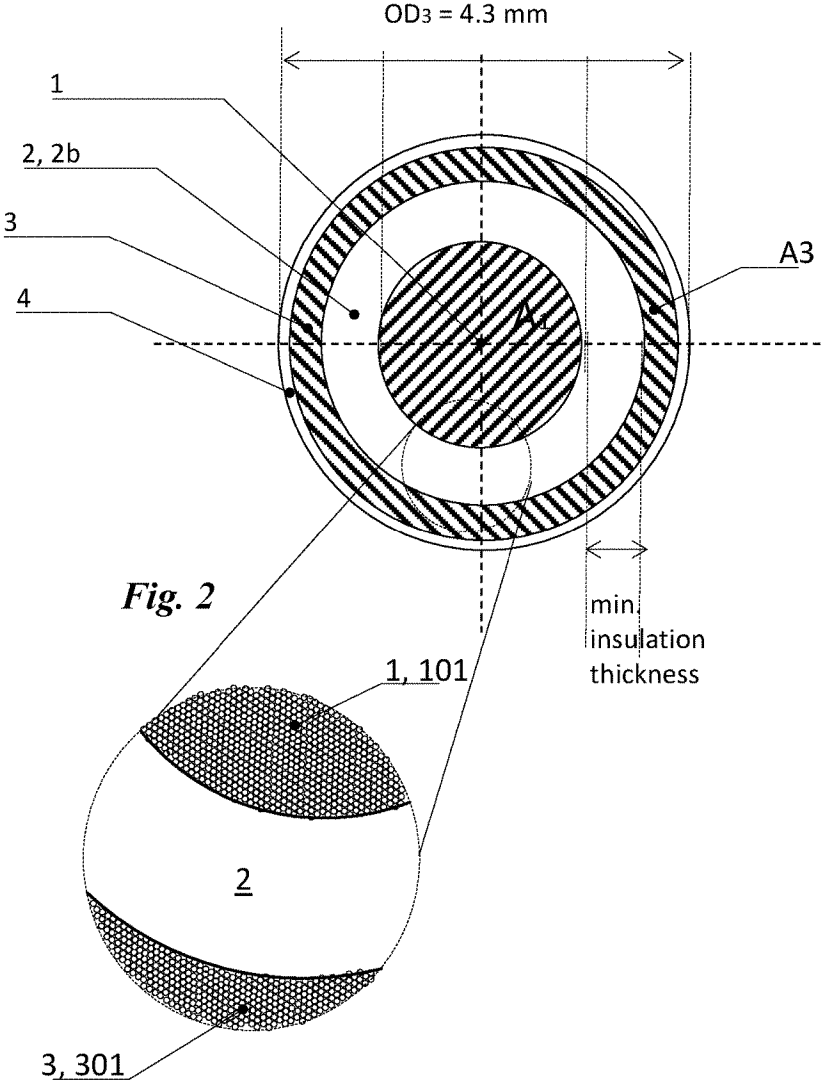
FIG. 2 is an illustration of the general coaxial conductor portion (1,2,3) of the fibre composite rod petroleum well intervention power cable of the invention, illustrating an embodiment of the core.

The invention is a fibre composite rod petroleum well intervention power cable (0) of which a cross-section is shown in FIG. 1 for a general view, and in embodiments in FIG. 4, FIG. 5, and FIG. 6 for embodiments of rods having 12 mm Ø, 10 mm Ø, and 8 mm Ø, respectively. Another embodiment is shown in FIG. 8 both in cross-section and in partially stripped lateral view of an end portion. The reason for defining the present invention as "a rod" is due to the fact that its bending stiffness is far higher than for an ordinary electrical intervention cable. The bending stiffness of rods according to the invention of diameters of 12 mm, 10 mm, and 8 mm, are 145.4 Pa $m^4$, 68.6 Pa $m^4$, and 27.0 $m^4$ respectively. With this high bending stiffness the rod power cable of the invention is capable of being rodded down through a grease injector and a tool housing on a petroleum wellhead. The pushing or so-called rodding mechanism above the grease injector is a wellhead injector with a motor-driven double tractor belt mechanism. The fibre composite rod intervention power cable (0) according to the invention is for a petroleum well, and needs a length of at least 2 to 10 km or more. It comprises in the following sequence:

As a core, a central electrical cable portion (1, 2, 3), please see the cross-section in FIG. 2.

A bonding layer (4) between the outer part of the cable portion (3) and a subsequent carbon fibre composite mantle layer (5). In an embodiment the bonding layer (4) is insulating, too.

The above mentioned carbon fibre composite mantle layer (5), wherein the carbon fibres are generally unidirectional parallel to the cable axis. This is illustrated in FIGS. 1, 4, 5, 6, and 8. This mantle layer (5) is extruded onto the bonding layer (4). The mantle layer (5) contributes the largest proportion of the tensile strength of the rod of the present invention.

A braided fibre composite layer (6), best seen in FIG. 8, is extruded onto the mantle layer (5).

The central electrical cable portion (1, 2, 3) illustrated in FIG. 2 comprises a generally central electrical conductor (1) with a first cross-section conductive area (A1), or with a first conductivity (S1), an inner insulation layer (2) on said central electrical conductor (1), and a coaxial electrical conductor layer (3) having a second cross section conductive area (A2) equal to said first cross-section conductive area (A1), or a second conductivity (S2) equal to the first conductivity (S1).

Because the important issue is to have the same conductivity both ways through the central and return coaxial conductors of the intervention rod of the invention, and one would usually use copper conductor strands for both, equal cross-section areas would provide equal conductivities. But one could have embodiments wherein Copper is used for the first electrical conductor (1) and Aluminium for the second conductor (3). So stated otherwise, the invention is a fibre composite rod petroleum well intervention power cable (0) comprising, in the following sequence:

a central electrical cable portion (1, 2, 3), a bonding layer (4), a generally unidirectional carbon fibre composite mantle layer (5), characterized by a braided fibre composite layer (6), wherein said central electrical cable portion (1, 2, 3) comprises a generally central electrical conductor (1) with a first conductivity (S1)

an inner insulation layer (2) on said central electrical conductor (1), and a coaxial electrical conductor layer (3) having a second conductivity (S2) equal to said first conductivity (S1).

The unidirectional carbon fibre mantle layer (5) and the braided carbon fibre layer (6) form the structurally supporting mantle portion of the rod intervention cable. The electrical cable portion is not self-supporting in a well, nor may it support a well instrument of any significant weight in a well, as its tensile strength is far too low, and its mechanical properties are insufficient for the hostile environment in a well. As illustrated in FIGS. 1, 4, 5, and 6, and also in FIG. 8, the unidirectional mantle layer (5) forms the mechanically dominating cross-section area of the composite fibre mantle portion, contributing to both the resulting intervention rod's mechanical bending stiffness and tensile strength.

The Central Electrical Cable Portion

As the central electrical cable portion (1, 2, 3) comprising the central electrical conductor (1) and the surrounding coaxial electrical conductor layer (3) is not self-supporting, it is an advantage to have a generally continuous bonding layer (4) to the structurally supporting carbon fibre mantle layer (5). When the rod of the invention is operated inside the petroleum well and having one end fixed on a drum and fed out from the drum, via a guide arch through a wellhead injector such as a tractor belt injector on a grease lubricator, the rod is subject to bending and compressive forces which could incur differential movement between the electrical cable core and the structural carbon fibre mantle. The bonding layer (4) ensures that there is no differential movement between the central electrical cable portion (1, 2, 3) and the structurally supporting carbon fibre mantle layer (5).

The Unidirectional Mantle Layer

The unidirectional composite carbon fibre layer (5) may be of either standard or high modulus carbon fibre. The matrix of the unidirectional fibre composite mantle layer (5) is high temperature thermoset or thermoplastic resin. In preferred embodiments of the invention the matrix is epoxy resin, phenolic resin, or bismaleimide (BMI) resin.

The Braided Layer

The braided layer (6) contributes both to the longitudinal tensile strength of the cable and the compressional strength of the cable. It is, in a preferred embodiment of the invention, torsion balanced, i.e. that the braided layer (6) is helical and comprises dextral and sinistral helix braided coil loops which provide the same but oppositely directed torsion strengths when arranged as part of the rod. In this manner the rod will be prevented from twisting when loaded or unloaded. In an embodiment it is a carbon fibre composite layer, but high tensile strength glass fibre or aramide fibre may be employed. In the illustrated embodiments in FIGS. 4, 5, and 6 the thickness is very thin, between 0.4 mm and 1.0 mm, here 0.8 mm, as compared to the much thicker unidirectional mantle composite carbon fibre layer (5) which constitutes the bulk of the structural mantle portion. The braided layer has an angle of 30, 45 or 60 degrees with the axial direction. The higher the braided angle the higher the hoop stress it may restrain. A test sample of the petroleum well intervention rod cable of the invention has a smeared-out structure arisen during the pultrusion process, a densely matrix-filled, void-free regularly braided fibre composite layer (6) with clearly visible broad bundles of carbon fibre, such as illustrated in FIG. 8, right portion. In this embodiment a surface coating (7) is applied on the braided fibre composite layer (6). The fibres of said braided layer (6) are carbon fibres or glass fibres or aramid fibres.

The braided fibre composite layer (6) has several functional advantages:

a) Improved Radial Strength

The generally axially oriented unidirectional carbon fibres in the carbon fibre composite mantle layer (5) provide a very high axial tensile strength. However their radial tensile strength is determined by the matrix and the matrix/carbon fibre bonding strength, there are no transversely arranged fibres in mantle layer (5). The oppositely wound braid fibre strands of the braided fibre composite layer (6) each work as a helical reinforcement which prevents radial disruption of the underlying unidirectional carbon fibres in case of radial forces should arise. Such disruption may arise during rodding which incurs compressive forces which may give rise to radial pressure in the rod. Such disruption may also arise after gas development due to intruded fluids, please see below. The strength of the helical reinforcement increases with an increasing angle of the angle with the axial direction. The composite braided fibre composite layer (6) is, in a preferred embodiment, braided onto the unidirectional fibre composite mantle layer (5) in a common pultrusion process simultaneously with the arrangement of the unidirectional fibre mantle layer (5) on the temporarily outer, bonding layer (4) of the electrical conductor cable portion (1, 2, 3).

b) Fluid-Proofness

A further effect of the composite braided fibre composite layer (6) is that it is very densely packed and completely wetted by the resin so as to provide a good degree of fluid-proofness so as for preventing water, gas and oil from intruding into the unidirectional fibre mantle layer (5) and further inward, so as for preventing gas pressure disruption of the rod. Thus the braided fibre composite layer both prevents or significantly reduces fluid intrusion, and, if fluid has entered, the braided fibre composite layer prevents disruption. The optional surface coating layer (7) will further improve fluid proofness.

c) Increased Toughness

The braided fibre composite layer (6) is made from braided bundles of carbon fibre or glass fibre, and is a damage tolerant braided layer, i.e. it does not disintegrate if one or more strands are broken such as may occur due to abrasion in the well. In the embodiment used for testing we have used epoxy resin for the matrix.

Details of the Electrical Cable Portion

In an embodiment of the electrical conductor cable portion (1, 2, 3) with the bonding layer (4), it may have the following properties:

- the central electrical conductor is a so-called American wire gauge (AWG) 13 with 133 conductor filaments (101) of 0.02 $mm^2$=2.63 $mm^2$ cross-section area $A_1$.
- the inner insulation layer (2) is a perfluoroalkoxy alkane (PFA) layer with 0.130 inch (3.3 mm) OD.
- a barrier layer (2*b*) of thickness 0.02 inch, (0.06 mm). In an embodiment this is a so-called Kapton polyimide heat sealable tape wound with 50% overlap.
- the coaxial conductor (3) is an AWG 36 NPC braid of 200 conductor filaments (301), of cross-section area $A_3$=2.65 $mm^2$, practically as close as one gets to the area $A_1$.
- the bonding layer (4) of thickness 0.02 inch, (0.06 mm). In an embodiment this is a so-called Kapton heat sealable tape wound with 50% overlap. This bonding layer (4) provides good bonding to the matrix of the surrounding unidirectional fibre composite mantle layer (5) and is chemically compatible to the polymer matrix of the fibre composite mantle layer (5). It also has an insulating property.

One or both of said electrical conductors (1, 3) comprise conductive filaments (101, 301), please see the enlarged portion of FIG. 2, as described above, in order to tolerate repeated bending of the rod cable. The conductive filaments (101, 301) may be twisted or braided so as for being bending-tolerant and/or elongation-tolerant, particularly in order for tolerating a certain degree of extension during tensile loading of the entire rod cable during hauling out from the petroleum well. Alternatively one or both of said electrical conductors (1, 2) are manufactured in massive metal if the modulus of the fibre composite layers provides sufficiently low elongation of the metallic conductors.

The outer diameter of the above electrical cable part is 4.37 mm+/−0.1 mm. The loop resistance is 15 Ohm/km, and the insulation resistance is 500 GOhm/km. The temperature rating is up to 260 degrees Celsius for continuous heating and 280 degrees Celsius for short term. This temperature tolerance allows the pultrusion process to be run at such high temperatures which may be required for thermoset or thermoplastic matrixes, or which may arise due to friction in the pultrusion process as such.

The purpose of having the same area cross-sections A1=A2 or in practice the same conductivity, of the two coaxial components of the cable is threefold:

Minimize Power Loss

Firstly, to have a power current having the same voltage drop both ways, down and up of the well (wherein the current has to run through the entire cable length always) in a length determined by the total length of the cable. The cable is 10 km in an embodiment and should for practical reasons be in one homogenous piece.

Minimize Electrical Cable Portion Radius

Secondly, it is advantageous to have a minimal outer radius of the insulated, tubular coaxial conductor layer (3) in order to provide a minimal inner radius of the surrounding unidirectional fibre composite mantle layer (5) in order to increase the unidirectional fibre composite layer's cross-sectional area and thus its load-bearing capacity, because the outer diameter of the total cable is pre-defined from overall considerations.

Reduce Weight to Strength Ratio

Thirdly, due to the lower density of the stronger Carbon fibre compared to the more ductile and denser Copper, with a thin copper coaxial conductor layer the weight reduction rate is more than the tensile capacity increase rate. The difference between the coaxial-type rod power cable of the invention and a parallel-conductor-type rod power cable is understood when comparing FIG. 4 with FIG. 7.

Background Art Details

FIG. 7 illustrates a background art fibre composite rod power cable with two parallel conductors each having a cross-section area $A_1$ of 2.63 $mm^2$. Each parallel conductor is provided with an insulation layer and a high temperature tolerant polymer layer fill-in enveloping the two parallel insulated conductors. The two parallel conductors are in practice twisted 14 to 20 times per meter in order to keep the two insulated conductors centrally during the process of covering with high-temperature polymer. A disadvantage is that the two insulation layers requires a minimum extrusion cover of high-temperature resistant fill-in polymer at either sides of the twisted core in order to form a sufficiently thick polymer layer to properly cover and protect the two electrical cables' insulation layers at either side to protect the insulation from the subsequent pultrusion process for adding a unidirectional carbon fibre layer. Thus the total diameter $D_{large}$ of the central electrical cable portion shown in FIG. 7 is about 6.2 mm.

Comparison with Background Art Cable.

We have prepared the table below for comparing the resulting carbon fibre area of the structural parts of the unidirectional carbon fibre composite mantle and the fibre composite braided layer (5, 6) of the rod of the present invention as shown in FIGS. 4, 5 and 6 compared with the cross-section structural fibre area of the background art shown in FIG. 7.

| | Ø rod, outer, mm | Bending stiffness Pa $m^4$ | Ø el. cable core portion, mm | Area el. cable portion, $mm^2$ | Area rod total, $mm^2$ | Area carbon fibre mantle (5, 6) $mm^2$ | carbon fibre Area ratio |
|---|---|---|---|---|---|---|---|
| Present invention | 12 | 145 | 4.2 | 14 | 113 | 99 | 1.20 |
| Background art | 12 | | 6.2 | 30 | 113 | 83 | |
| Present invention | 10 | 69 | 4.2 | 14 | 79 | 65 | 1.34 |
| Background art | 10 | | 6.2 | 30 | 79 | 48 | |
| Present invention | 8 | 27 | 4.2 | 14 | 50 | 36 | 1.81 |
| Background art | 8 | | 6.2 | 30 | 50 | 20 | |

The carbon fibre area differences between the 12 mm Ø, 10 mm Ø, and 8 mm Ø, as illustrated in FIGS. 4, 5, and 6 respectively, and the background art cable of corresponding diameters of which only the one with 12 mm Ø illustrated in FIG. 7, are the same:

Ø 12 mm: 99 $mm^2$-83 $mm^2$=16 $mm^2$;

Ø 10 mm: 65 $mm^2$-48 $mm^2$=15 $mm^2$; and

Ø 8 mm: 36 $mm^2$-20 $mm^2$=16 $mm^2$.

The differences between 15 $mm^2$ and 16 $mm^2$ in the table above are due to rounding errors. The proportional increases of the structural fibre layer cross sections are 20%, 34%, and 81%, respectively. Thus, for the 8 mm Ø rod it is rather too weak to be feasibly used in a well, while the rod of the present invention has more than 80% improved tensile strength while having an acceptable bending stiffness.

Further Embodiment Details

In a preferred embodiment the fibre composite rod intervention cable (0) of the invention one or both of said electrical conductors (1, 2) are made in Copper. Alternatively one or both of said electrical conductors (1, 2) are made in Aluminium.

The Bonding Layer

The bonding layer (4) is in an embodiment of the invention a thermoplastic material with high thermal stability such as polyimide. In an embodiment of the invention the bonding layer (4) is a heat sealable tape.

The Mantle Matrix

In an embodiment of the invention the fibre composite rod intervention cable (0) of any of the preceding claims, comprises a surface coating (7). The surface coating (7) is made in thermoplastics, Polyether Imide (PEI), Polyether ether ketone (PEEK), or Polyarylether ketone (PAEK).

Carbon Fibre Quality

The fibre composite mantle layer (5) is unidirectional carbon fibre of either standard modulus (225 to 260 GPa) or High modulus (250 to 650 GPa).

Braided Layer Material

The braided fibre composite layer (6) is made in carbon fibre, or so-called S-glass high strength fibre or aramid fibre.

The invention may be seen as a combined fibre composite rod intervention cable with a unidirectional fibre composite mantle layer, a protective braided fibre composite layer and a centrally arranged cross section area-balanced copper coaxial cable portion, or vice versa.

Advantages of the Invention

General

A fibre composite rod intervention cable with a protective braided fibre composite layer will solve imminent technical problems related to purely mechanical wear and tear but also prevent intrusion of gases or liquids at high pressure during operation. A fibre composite rod intervention cable with copper conductors with equal cross-section centre and coaxial cable conductive areas according to the invention will be forward-and-return DC conductivity balanced and primarily solves the actual problem related to maximizing the conductivity and reducing the resistive loss of the fibre composite rod intervention cable.

However, a combination of the two, as illustrated in FIG. 1 and defined above, has further advantages than each part in itself:

The total diameter of the intervention rod is given as e.g. 12 mm, 10 mm, or 8 mm. The total diameter of the intervention rod is given by one or more factors: The total diameter and size of the cable drum which shall accommodate, say, 10 000 meters of the intervention cable rod. The thicker the rod, the larger the minimum curvature of the drum, which may be about 4 m for a 12 mm rod.

Increased Tensile Strength to Weight

The reduced outer radius of the cross-section area of the tubular outer copper conductor (which is not a "screen" in its present context) will increase the available inner radius cross-section area for the unidirectional carbon fibre mantle layer (5), increasing the tensile strength of the unidirectional carbon fibre layer (5), which carries the bulk weight of the intervention rod, proportionally with the ratio of the saved copper area to the original unidirectional fibre composite area. Thus more is gained than only the area saved, given the outer diameter limitation. A longer or stronger cable results.

The Ratio cross section area of the UD mantle layer (5)/unit length weight, increases more than linearly because the copper weight saved is more than the UD cross section area gained. A lighter stronger cable results.

The resulting lighter intervention rod cable with the braided fibre composite layer (6) obtains the required equal electrical return currents in conductive layers (1, 3), may obtain longer extent into a well, and will be abrasion-tolerant and will prevent UD fibre mantle layer (5) disruption due to the hoop stress tolerant braided fibre composite layer (6).

Improved Decompression Tolerance

The fibre composite rod cable of the invention has an improved so-called "rapid gas decompression performance". The matrix cured or otherwise matrix consolidated braided fibre composite layer (6) arranged near the outer surface of the rod may be made rather fluid-proof and will provide protection against fluids under high pressure to enter the UD fibre layer. A fluid-free unidirectional fibre composite mantle layer (5) will thus have a significantly reduced risk of radial disruption due to gas formation from undesired accumulated high pressure liquids when the outer pressure is relieved when running out of the well. This prevents radial disruption of the composite intervention rod cable. Despite the improved fluid-proofness of the braided layer (6) (when cured in matrix and covered by surface layer (7)) some fluid intrusion may occur under high pressure if scars arise in the outer layers (7) and/or (6). Radial forces in the UD fibre mantle layer (5) due to high pressure bubble formation will then be restrained by the hoop winding effect of the braided layer (6) thus preventing disruption to a far better degree than UD-only composite rods.

Increased Torsion Stiffness

The consolidated or cured matrix bonded braided fibre composite layer (6) arranged near the outer surface of the rod will, in addition to the above advantages, also contribute to the stiffness of the rod but also to increased torsion stiffness. Further, the balanced torsion strength of the oppositely directed helixes of the braided fibres prevents relative rotation when the load increases or decreases on the rod cable.

Increased Fluid-Proofness

The fluid-proofness of the braided fibre composite layer (6), particularly when matrix-filled and further when covered by a surface coating layer (7) will also provide an improved protection against fluid intrusion and subsequent chemical degradation of the UD fibre composite layer and the coaxial conductor outer layer, and maintain the electrical conductivity.

Improved Rodding Properties

The rodding into the hole by the rodding tool, i.e. the injector, which may be a wellhead vertical tractor belt injector of some kind, will incur compressive forces longitudinal to the composite rod. A radial pressure will arise in the UD fibre mantle layer (5) which is counteracted by the hoop windings effectively constituted by the braided layer (6). Thus the composite rod of the invention may withstand a higher injection force from the injector than what may be the withstood by prior art composite intervention rod cables.

Manufacture Chain

An electrical power cable of the background art as shown in the cross-section of FIG. 3 is rather easily manufactured in the same process leading to the pultrusion of the unidirectional carbon fibre layer shown in FIG. 7. The manufacturing of the present invention's coaxial electrical conductor cable core is, due to the complexity of each part of the manufacturing process, neither feasible for the electrical power cable supplier, nor for the carbon fibre rod pultrusion facility. The test runs for manufacturing the rod of the present invention such as shown in FIG. 8 has been as follows: The manufacturing of the electrical cable core is made by one specialized supplier and shipped to the fibre composite rod pultrusion facility at another specialized provider, neither of those being able to manufacture the combined product alone. In future a combined coaxial power conductor manufacturing line with a carbon fibre pultrusion facility may be feasible, combining the two manufacturing specialties.

Uniform Bending Strength

An easily overseen advantage of the rod according to the present invention is its uniform bending stiffness due to its azimuthally uniform electrical core and mantle construction, as opposed to designs of non-coaxial but parallel conductors in a polymer matrix electrical cable core which will not compress uniformly, due to the existing inhomogeneity along the length of the cable which occurs with a period of the twisting of the parallel conductors. Also the radial compressibility of the present intervention rod will be azimuthally uniform. This results in the advantage that the cable will have no significantly weaker portions with reduced bending stiffness. Further, when set under pressure, the rod will compress uniformly and will not reduce any diameter more than any other, and will thus have a reduced buckling tendency. This reduced buckling tendency further reduces the risk of disruption of the rod while rodding into the well at the wellhead injector.

The invention claimed is:

1. A fibre composite rod petroleum well intervention power cable comprising, in the following sequence:

a central electrical cable portion, a bonding layer, a generally unidirectional carbon fibre composite mantle layer, and a braided fibre composite layer, wherein said central electrical cable portion comprises:

a generally central electrical conductor with a first conductivity, an inner insulation layer on said central electrical conductor, and a coaxial electrical conductor layer having a second conductivity equal to said first conductivity.

2. The fibre composite rod petroleum well intervention power cable of claim 1, wherein said electrical conductor has a first cross-section conductive area and said coaxial electrical conductor layer having a second cross section conductive area equal to said first cross-section conductive area.

3. The fibre composite rod petroleum well intervention cable of claim 1, wherein one or both of said electrical conductors are made in copper.

4. The fibre composite rod petroleum well intervention cable of claim 1, wherein one or both of said electrical conductors are made in aluminium.

5. The fibre composite rod petroleum well intervention cable of claim 1, wherein one or both of said electrical conductors comprise conductive strands.

6. The fibre composite rod petroleum well intervention cable of claim 5, wherein said conductive strands are twisted or braided.

7. The fibre composite rod petroleum well intervention cable of claim 1, wherein one or both of said electrical conductors are solid metal.

8. The fibre composite rod petroleum well intervention cable of claim 1, comprising a surface coating on said braided fibre composite layer.

9. The composite petroleum well fibre rod intervention cable of claim 8, wherein said surface coating is thermoplastics, polyether Imide (PEI), polyether ketone (PEEK), polyarylether ketone (PAEK).

10. The fibre composite rod petroleum well intervention cable of claim 1, said bonding layer being electrically insulating.

11. The fibre composite rod petroleum well intervention cable of claim 1, wherein said braided fibre composite layer is balanced with regard to a torsion strength of oppositely directed layers.

12. The composite petroleum well fibre rod intervention cable of claim 1, wherein a matrix of said unidirectional fibre composite layer is high temperature thermoset or thermoplastic resin.

13. The composite petroleum well fibre rod intervention cable of claim 12, wherein said matrix is epoxy resin, phenolic resin, or bismaleimide (BMI) resin.

14. The composite petroleum well fibre rod intervention cable of claim 1, wherein a matrix of said braided fibre composite layer is a high temperature thermoset or thermoplastic resin.

15. The composite petroleum well fibre rod intervention cable of claim 1, wherein the cross-section area of said central electrical conductor is 2.6 $mm^2$.

16. The composite petroleum well fibre rod intervention cable of claim 1, said central conductor comprising 133 conductor filaments of 0.02 $mm^2$ cross section area each.

17. The composite petroleum well fibre rod intervention cable of claim 1, said inner insulation layer is a perfluoroalkoxy alkane (PFA) layer with 0.130 inch (3.3 mm) outer diameter.

18. The composite petroleum well fibre rod intervention cable of claim 1 said inner insulation layer comprising a barrier layer having a thickness of 0.06 mm.

19. The composite petroleum well fibre rod intervention cable of claim 18, said barrier layer being a wound heat sealable tape wound with partial overlap.

20. The composite petroleum well fibre rod intervention cable of claim 1, said coaxial conductor comprising a braid of 200 conductor filaments, and having a cross-section area equal to 2.6 $mm^2$.

21. The composite petroleum well fibre rod intervention cable of claim 1, the bonding layer having a thickness of 0.06 mm.

22. The composite petroleum well fibre rod intervention cable of claim 21, said bonding layer comprising a heat sealable tape wound with overlap.

23. The composite petroleum well fibre rod intervention cable of claim 1, wherein a braiding angle of said braided fibre composite layer is between 30 and 60 degrees with the axial direction.

24. The composite petroleum well fibre rod intervention cable of claim 1, wherein the fibres of said braided layer are carbon fibres, glass fibres, or aramid fibres.

* * * * *